United States Patent [19]

Inaguma et al.

[11] Patent Number: 4,939,990

[45] Date of Patent: Jul. 10, 1990

[54] MULTI-SURFACED ROTARY STAMPING APPARATUS

[75] Inventors: Shoichi Inaguma; Masayuki Hasegawa; Akira Ichihashi, all of Nagoya, Japan

[73] Assignee: Shachibata Industrial Co., Ltd., Japan

[21] Appl. No.: 357,765

[22] Filed: May 26, 1989

[30] Foreign Application Priority Data

May 31, 1988 [JP] Japan ..... 63-72661[U]
Aug. 2, 1988 [JP] Japan ..... 63-102645[U]

[51] Int. Cl.[5] ..... B41J 1/36

[52] U.S. Cl. ..... 101/109; 101/405; 101/93.37

[58] Field of Search ..... 101/109, 110, 405, 406, 101/381, 93.37

[56] References Cited

U.S. PATENT DOCUMENTS

| | | | |
|---|---|---|---|
| 2,176,160 | 10/1939 | Uhl, Jr. | 101/381 |
| 2,899,895 | 8/1959 | Tannery | 101/381 |
| 3,478,682 | 5/1967 | Funahashi | 101/327 |
| 3,524,406 | 8/1970 | Traynor | 101/93 |
| 4,676,162 | 6/1987 | Phipps et al. | 101/405 |

FOREIGN PATENT DOCUMENTS

| | | | |
|---|---|---|---|
| 5282415 | 12/1950 | Japan . | |
| 5698464 | 12/1954 | Japan . | |
| 5750363 | 9/1955 | Japan . | |
| 5812461 | 7/1956 | Japan . | |
| 48-23537 | 7/1973 | Japan . | |
| 53-6318 | 1/1978 | Japan | 101/109 |
| 53-48013 | 11/1978 | Japan . | |
| 2050250A | 1/1981 | United Kingdom . | |

*Primary Examiner*—Edgar S. Burr
*Assistant Examiner*—Ren Yan
*Attorney, Agent, or Firm*—Mason, Fenwick and Lawrence

[57] ABSTRACT

The present invention provides a rotary stamping apparatus including a shaft member having a polygonal configuration in a cross-section perpendicular to its axis of rotation and holding a plurality of stamp cartridges faced outwardly; a gripper case for supporting the shaft member at its opposite sides, the gripper case having an invert U-shaped configuration in cross-section; an elevator frame slidably mounted within the gripper case and movable between an outer position in which the outer end of the elevator frame is positioned outwardly from a plane including one of the stamp cartridges located in its usable position and an inner position in which the elevator frame is retracted inwardly from the plane, the elevator frame being resiliently biased toward the outer position; a selector knob for rotating the shaft member to the desired position; and each of the stamp cartridges being capable of being detachably mounted on the shaft member by sliding the stamp cartridge in the plane of rotation of the shaft member.

8 Claims, 4 Drawing Sheets

MULTI-SURFACED ROTARY STAMPING APPARATUS

BACKGROUND OF THE INVENTION

1. Field of the Invention

The present invention relates to a multi-surfaced rotary stamping apparatus including a plurality of stamp faces each of which can be positioned in use.

2. Description of the Prior Art

One of multi-surfaced rotary stamping apparatuses comprising a gripper case and a rotary drum having a plurality of stamp faces and retractably mounted within the gripper case is known, for example, by Japanese Utility Model Laid-Open Application No. 53-6318.

The conventional stamping devices of such a type is complicated in structure and assembled with much time. Further, the replacement of the stamping faces around the rotary drum by new stamping faces cannot be performed properly and easily. In addition, the confirmation of a stamp face positioned at the opened bottom of the gripper case can be made only by viewing that stamp face when the gripper case is turned upside down. There is a further problem in that the dimension of the stamp face is relatively small in comparison with the external dimension of the stamping apparatus.

SUMMARY OF THE INVENTION

It is therefore an object of the present invention to provide a multi-surfaced rotary stamping apparatus in which the confirmation of a stamp face positioned at the bottom of the gripper case can be made only by viewing one side of the gripper case without returning it upside down.

Another object of the present invention is to provide a multi-surfaced rotary stamping apparatus in which the replacement of the stamp faces in the stamping apparatus can be performed easily and positively.

Still another object of the present invention is to provide a multi-surfaced rotary stamping apparatus which is simplified in structure and can be assembled easily and simply while maintaining the aforementioned advantages.

DETAILED DESCRIPTION OF THE PREFERRED EMBODIMENTS

Figure 1:
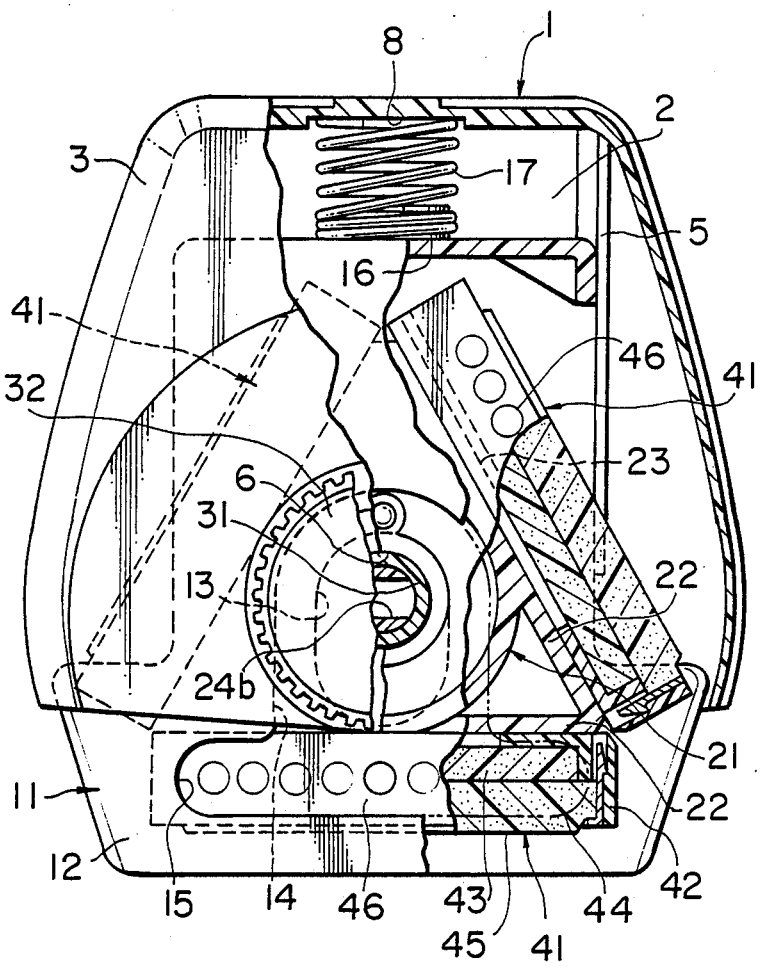
FIG. 1 is a front elevational view, partially broken away, of one embodiment of a multi-surfaced rotary stamping apparatus constructed in accordance with the present invention.
Figure 2:
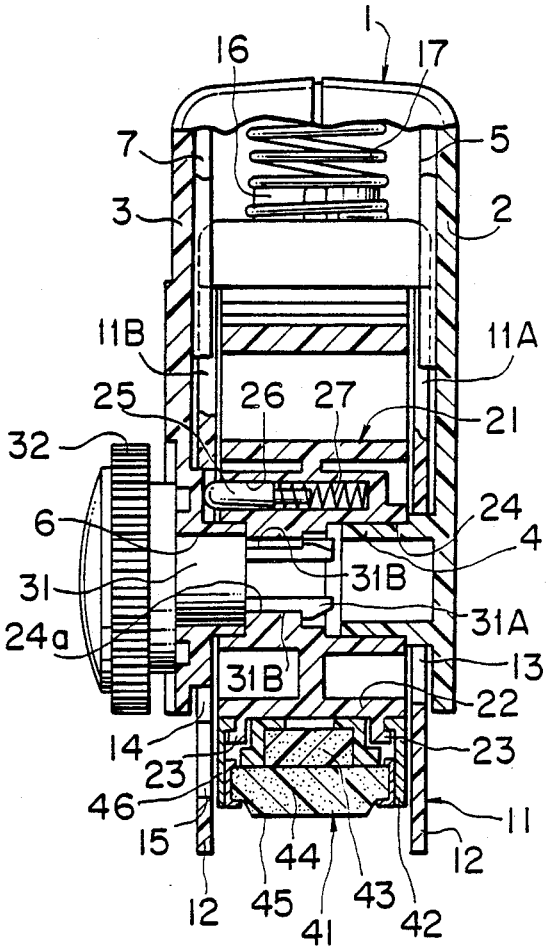
FIG. 2 is a side cross-sectional view of the multi-surfaced rotary stamping apparatus shown in FIG. 1.

Referring now to FIGS. 1 and 2, there is shown the first embodiment of a multi-surfaced rotary stamping apparatus according to the present invention.

The rotary stamping apparatus comprises a two-split type gripper case 1 comprising two covering members 2 and 3 which are molded from a synthetic resin material such as ABS. One of the covering members 2 includes a drum receiving shaft 4 and a pair of spaced parallel slide guides 5, the shaft and slide guides being formed in the covering member 2 at its inner wall. The other covering member 3 includes a shaft hole 6 formed therein at a position opposite to the drum receiving shaft 4 of the one covering member 2 and a pair of slide guides 7 each formed in the other covering member 3 at a position opposite to the corresponding slide guide 5 on the one covering member 2.

Each of the covering members 2 and 3 includes a spring-receiving half 8 formed therein at its inner top wall, the spring-receiving halves 8 on the covering members 2 and 3 co-operating with each other to provide a top spring seat in the gripper case.

The gripper case 1 receives an elevator frame 11 having an invert U-shaped configuration in cross-section and includes side walls 11A and 11B each of which is received between the slide guides (5 or 7) on the inner wall of the corresponding covering member (2 or 3). Each of the side walls 11A or 11B has a covering leg portion 12 extending outwardly from the bottom end of the corresponding side wall. The elevator frame 11 is similarly molded from a synthetic resin material such as ABS.

The elevator frame 11 includes an elongated slot 13 formed on one of the side walls (11B in FIG. 2) and adapted to receive and engage the drum receiving shaft 4. The other side wall (11A in FIG. 2) of the elevator frame 11 is formed with another slot 14 permitting the longitudinal movement of an operating shaft 31 which will be described hereinafter. The other slot 14 communicates with a viewing window 15 formed in the corresponding side wall 11B of the elevator frame 11 and extending traversely of the bottom end of that side wall.

The elevator frame 11 further includes a spring seat 16 formed on the outer top wall thereof. A coil spring 17 is operatively located between this spring seat 16 and the spring seat 8 of the gripper case 1 to bias the elevator frame 11 outwardly through the opened bottom of the gripper case 1. In such a situation, the elevator frame 11 housed within the gripper case 1 is biased outwardly under the action of the spring 17 to position the lower halves of the covering leg portions 12 in the elevator frame 11 externally of the gripper case 1 through the opened bottom thereof.

There is provided a polygonal drum 21 molded from a synthetic resin material such as polypropylene. In the illustrated embodiment, the polygonal drum 21 is of a triangle configuration having three edge faces 22 each of which is provided with a cartridge receiver 23 extending longitudinally thereon. The polygonal drum 21 includes a bearing opening 24 formed therein at one side, the bearing opening 24 engaging over the drum receiving shift 4 of the gripper case 1 to rotatably support the polygonal drum 21 thereon. A connecting opening 24*a* is also formed in the polygonal drum 21 through the other wall thereof and connected with the bearing opening 24. The connecting opening 24*a* is adapted to receive the inner end 31A of the operating shaft 31 through the shaft hole 6 of the gripper case 1. The inner end 31A of the operating shaft 31 includes a pair of flats 31B formed therein, which flats are adapted to engage the corresponding flats 24*b* formed on the inner wall of the connecting opening 24*a* so as to connect the operating shaft 31 firmly with the polygonal drum 21.

When the polygonal drum 21 is mounted within the elevator frame 11 between the opposite side walls thereof, the polygonal drum 21 is rotatably supported by the drum receiving shaft 4 of the covering member 2 in the gripper case 1 through engagement of the inner wall of the bearing opening 24 with the outer wall of the drum receiving shaft 4. The polygonal drum 21 is resiliently held by a combination of a pin 25, a pin opening 26 and a spring 27 in such a position that the desired one of the side edge faces 22 on the polygonal drum 21 is horizontally located slightly below the bottom edge of the gripper case 1.

As described hereinbefore, the operating shaft 31 is rigidly engaged by the connecting opening 24*a* of the polygonal drum 21 such that the latter can be rotated to position the desired one of the three edge faces 22 in place. A selector knob 32 is rigidly connected with the outer end of the operating shaft 31 extending outwardly through the shaft hole 6 of the covering member 3 in the gripper case 1.

A stamp cartridge 41 is detachably mounted on each of the edge faces 22 of the polygonal drum 21. The stamp cartridge 41 comprises a print frame 42 slidably engaged and held by the corresponding cartridge receiver 23 and formed from a synthetic resin material such as polyacetal. The print frame 42 holds an ink retaining member 43 and a porous printing member 44 made as from any suitable porous rubber material, the porous printing member 44 having its printing face 45 disposed beyond the bottom edge thereof. The print frame 42 includes a print face indicator 46 extending longitudinally along one side. The print face indicator 46 can be viewed easily through the viewing window 15 on the elevator frame 11. If the corresponding covering leg portion 12 of the elevator frame 11 is made of a transparent material, the viewing window 15 can be omitted.

In such an arrangement, the print face indicator 46 of each of the stamp cartridges 41 can be viewed by an operator through the covering leg portion 12 such that the operator will easily know which of the stamp cartridges 41 is presently located at the opened bottom of the gripper case 1. Since each of the stamp cartridges 41 can be detachably mounted on the corresponding edge face 22 of the polygonal drum 21 by slidably moving the stamp cartridge on the corresponding cartridge receiver 23 which slightly protrudes through the opened bottom of the gripper case 1, the replacement of the stamp cartridge 41 by another stamp cartridge can be simply and conveniently carried out without removal of the polygonal drum 21 from the gripper case 1. Since the gripper case 1 can be split into two covering members 2 and 3 which respectively include the drum receiving shaft 4 and the shaft hole 6 formed integrally therein, the components including the polygonal drum 21 and the elevator frame 11 can be incorporated positively into the gripper case 1 in the easy and simple manner. In addition, the elevator frame 11 can be moved smoothly along the slide guides 5 and 7 on the inner walls of the covering members 2 and 3.

Figure 3:
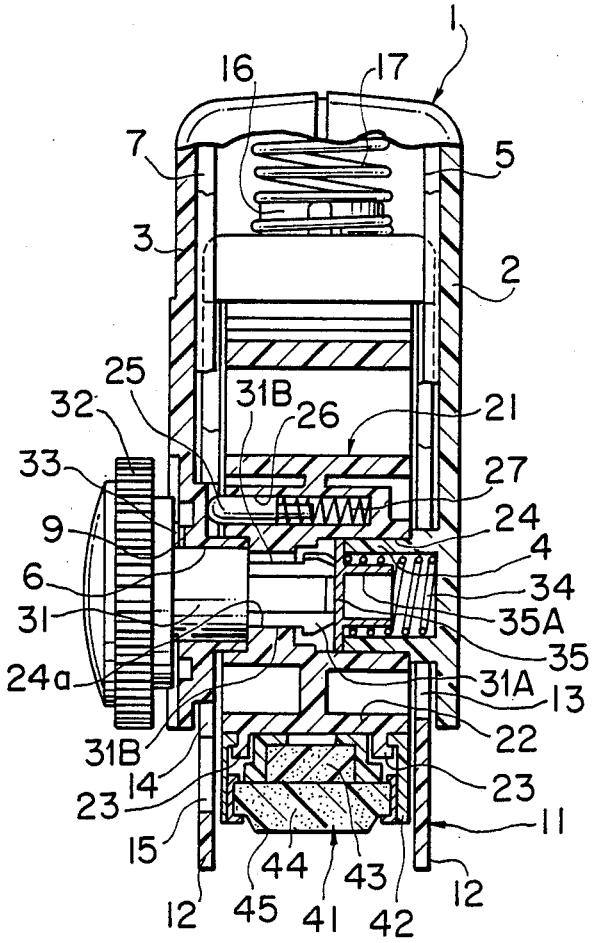
FIG. 3 is a view similar to FIG. 2, illustrating the second embodiment of a multi-surfaced rotary stamping apparatus constructed in accordance with the present invention.
Figure 4:
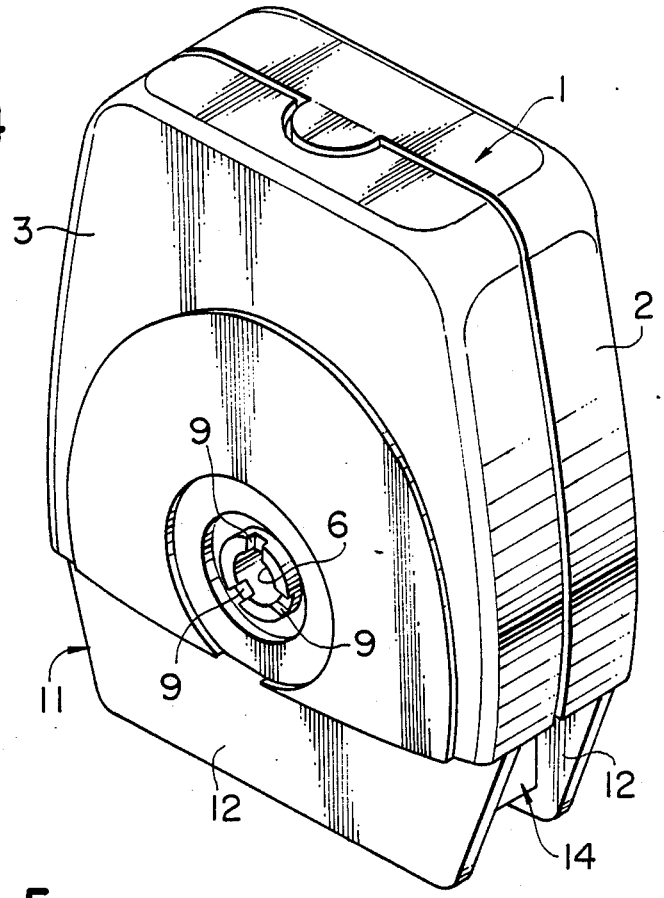
FIG. 4 is a perspective view of the gripper case in the second embodiment.
Figure 5:
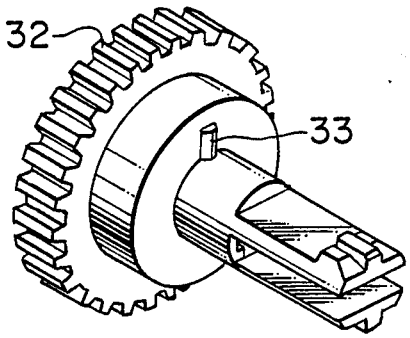
FIG. 5 is a perspective view of the selecting knob as viewed from the inner side thereof.

Referring now to FIGS. 3 through 5, there is shown the second embodiment of a multi-surfaced rotary stamping apparatus constructed in accordance with the present invention, which is of a structure substantially similar to that of the first embodiment except that the second embodiment includes means for holding the polygonal drum against movement when one of the stamp cartridges is to be replaced by another new stamp cartridge. Therefore, parts similar to those of the first embodiment will be denoted by similar reference numerals and will not further be described herein.

Said means for holding the polygonal drum against movement comprises a presser 35 engaged by the end face of the drum receiving shaft 4 on the covering member 2 and having a boss 35A received in the bore of the drum receiving shaft 4; a coil spring 34 received in the same bore of the drum receiving shaft 4, the spring having one end seating on the bottom of said bore with the other end engaging the inner face of the presser 35 around the boss 35A; and stopper means for holding the operating shaft 31 and thus the selector knob 32 against movement in position. The stopper means includes a plurality of angularly spaced recesses 9 formed in the covering member 3 at the outer end of the connecting opening 24*a* and a stopper 33 formed in the back face of the selector knob 32 at the outer end of the operating shaft 31 connected with the knob 32. The number and position of recesses 9 correspond to the number and position of the edge faces in the polygonal drum 21.

The selector knob 32 is normally biased outwardly away from the outer wall of the covering member 3 under the action of the coil spring 34 engaging the inner end 31A of the operating shaft 31. Thus, the selector knob 32 will be freely rotated to change one stamp cartridge to another on the polygonal drum 21. When it is to replace one stamp cartridge 41 by a new stamp cartridge, the selector knob 32 is urged inwardly toward the outer wall of the covering member 3 against the action of the coil spring 34. The stopper 33 is then moved into and engaged by one of the recesses 9 on the covering member 3 so as to hold the selector knob 32 in position. Accordingly, the replacement of the stamp cartridge 41 can be performed easily without any movement of the polygonal drum 21.

We claim:

1. A rotary stamping apparatus comprising:

a plurality of stamp cartridges, each of said stamp cartridges having a use position and at least one non-use position;

rotatable shaft means for holding said plurality of stamp cartridges faced outwardly, said shaft means having a plurality of edge faces and a polygonal transverse cross-section, and each of said stamp cartridges being slidably mounted on one of said edge faces;

a gripper case having a plurality of recesses formed therein;

elevator frame means for supporting said shaft means at its opposite sides, said elevator frame means having an inverted U-shaped configuration in cross-section and an outer end, and said elevator frame means further being slidably mounted within said gripper case and movable between an outer position in which said outer end is positioned outwardly from a plane including one of said stamp cartridges in its use position and in inner position in which said elevator frame means is retracted inwardly from said plane;

first biasing means for biasing said elevator frame means toward said outer position; and selector knob means for rotating said shaft means to the desired position, said selector knob mean shaving a back face and a stopper formed in said back face;

said stopper and said recesses defining engagement means for holding said shaft means in place, said stopper being movable in and out of engagement with said recesses, said engagement means being movable between an operative position when said stopper is in engagement with one of said recesses and in inoperative position when said stopper is out of engagement with one of said recesses; and second biasing means for normally biasing said selector knob means outwardly away from said gripper case, said selector knob means being movable against said second biasing means to move said engagement means into said operative position.

2. The rotary stamping apparatus of claim 1, wherein each of said stamp cartridges includes indicator means for confirming which of said stamp cartridges is in its use position, and said elevator frame means includes viewing means for viewing said indicator means of said stamp cartridge in its use position.

3. The rotary stamping apparatus of claim 2, wherein said viewing means comprises a window formed at one side of said elevator frame means.

4. The rotary stamping apparatus of claim 2, wherein said outer end of said elevator frame means is made of a transparent material and said transparent material comprises said viewing means.

5. A rotary stamping apparatus comprising:

a rotatable drum having a plurality of edge faces and a polygonal transverse cross-section;

a plurality of stamp cartridges, one of said stamp cartridges being mounted on each of said edge faces of said drum, and each of said stamp cartridges having a use position and at least one non-use position, and each of said stamp cartridges being slidably mounted on one of said edge faces;

a gripper case;

elevator frame means for supporting said rotatable drum at its opposite sides, said elevator frame means having an inverted U-shaped configuration in cross-section and an outer end, and said elevator frame means further being slidably mounted within said gripper case and movable between an outer position in which said outer end is positioned outwardly from a plane including one of said stamp cartridges in its use position and an inner position in which said elevator frame means is retracted inwardly from said plane;

first biasing means for biasing said elevator frame means toward said outer position;

selector knob means for rotating said rotatable drum to the desired position;

engagement means for holding said rotatable drum in place, said engagement means being movable between an operative position and an inoperative position; and second biasing means for normally biasing said engagement means to said inoperative position, said selector knob means being movable against said second biasing means to move said engagement means into said operative position.

6. The rotary stamping apparatus of claim 5, wherein each of said stamp cartridges includes indicator means for confirming which of said stamp cartridges is in its use position, and said elevator frame means includes viewing means for viewing said indicator means of said stamp cartridge in its use position.

7. The rotary stamping apparatus of claim 6, wherein said viewing means comprises a window formed at one side of said elevator frame means.

8. The rotary stamping apparatus of claim 6, wherein said outer end of said elevator frame means is made of a transparent material and said transparent material comprises said viewing means.

* * * * *

UNITED STATES PATENT AND TRADEMARK OFFICE

CERTIFICATE OF CORRECTION

PATENT NO. : 4,939,990

DATED : July 10, 1990

INVENTOR(S) : Shoichi Inaguma et al

It is certified that error appears in the above-identified patent and that said Letters Patent is hereby corrected as shown below:

On the title page:

Please correct the name of the assignee from "Shachibata Industrial Co., Ltd." to --Shachihata Industrial Co., Ltd.--.

Signed and Sealed this

Twenty-fourth Day of September, 1991

*Attest:*

HARRY F. MANBECK, JR.

*Attesting Officer*

*Commissioner of Patents and Trademarks*